United States Patent [19]

Miyamoto

[11] Patent Number: 4,726,283

[45] Date of Patent: Feb. 23, 1988

[54] SLIDE CYLINDER

[75] Inventor: Michikazu Miyamoto, Soka, Japan

[73] Assignee: Shoketsu Kinzoku Kogyo Kabushiki Kaisha, Tokyo, Japan

[21] Appl. No.: 848,375

[22] PCT Filed: Jul. 11, 1984

[86] PCT No.: PCT/JP84/00361

§ 371 Date: Mar. 17, 1986

§ 102(e) Date: Mar. 17, 1986

[87] PCT Pub. No.: WO86/00673

PCT Pub. Date: Jan. 30, 1986

[51] Int. Cl.[4] ..... F01B 31/00

[52] U.S. Cl. ..... 92/110; 92/59; 92/117 R; 92/146; 29/156.5 R

[58] Field of Search ..... 92/59, 110, 117 R, 146, 92/161; 91/14, DIG. 4; 29/156.5 R, 156.5 A, 515, 517; 403/274, 278, 279, 282, 360, 375

[56] References Cited

U.S. PATENT DOCUMENTS

| | | | |
|---|---|---|---|
| 577,342 | 2/1897 | Bain | 92/110 |
| 1,687,369 | 10/1928 | Lapointe | 92/146 X |
| 1,845,797 | 2/1932 | Kearney | 92/117 R |
| 1,955,744 | 4/1934 | Huffman | 92/146 X |
| 2,550,925 | 5/1951 | Weimar | 92/117 R X |
| 2,922,399 | 1/1960 | Panissidi et al. | 92/117 R |
| 3,146,681 | 9/1964 | Sheesley | 92/13.5 |
| 3,499,387 | 3/1970 | Zippel | 92/13.5 X |
| 3,994,539 | 11/1976 | Gottlieb . | |
| 4,176,586 | 12/1979 | Stoll et al. | 91/DIG. 4 X |
| 4,456,077 | 6/1984 | Lagerstedt et al. | 92/117 R X |
| 4,492,359 | 1/1985 | Baugh | 92/110 X |

FOREIGN PATENT DOCUMENTS

| | | | |
|---|---|---|---|
| 2306899 | 8/1974 | Fed. Rep. of Germany | 29/156.5 R |
| 911508 | 11/1962 | United Kingdom | 92/146 |

*Primary Examiner*—Robert E. Garrett
*Assistant Examiner*—Mark A. Williamson
*Attorney, Agent, or Firm*—Oblon, Fisher, Spivak, McClelland & Maier

[57] ABSTRACT

Disclosed herein is a slide cylinder basically consisting of a cylinder block internally defining a plural number of intercommunicating cylinder bores in parallel relation with each other, a piston and a piston rod fitted in each cylinder bore, and plate-like cross members integrally connecting the respective piston rods at the opposite ends thereof. The drive chambers defined by the pistons are communicated with fluid supply/discharge ports at the opposite ends of one of the piston rods and one of fluid supply/discharge ports provided in the cylinder block, permitting a diversity of piping modes by selective use of these ports. When installed upside down, it is possible to move either the cylinder block or cross plates whichever is desired. The slide cylinder can transfer loads accurately without involving rotational motion. Fixing of a piston against a piston rod is by means of caulking the ends of cylindrical portion of a piston at fixing grooves of a piston rod. This fixing work is simple and no backlash is permitted. A position sensor that permits applications for various purposes is easily installed.

11 Claims, 6 Drawing Figures

SLIDE CYLINDER

FIELD OF THE INVENTION

This invention relates to a slide cylinder which is provided with pressurized fluid supply/discharge ports at the opposite ends of cylinder block and piston rods and also with fixing means on the cylinder block and cross plates fixed to the opposite ends of the piston rods to facilitate piping of the pressurized fluid ducts to the slide cylinder without being restricted by the condition of an installing place.

BACKGROUND OF THE INVENTION

There have been known in the art the so-called slide cylinders which are constituted by a cylinder block with a couple of juxtaposed cylinders, a piston and a piston rod, reciprocating the piston by supplying and discharging a pressurized fluid to and from drive chambers which are defined in the cylinder block by the piston.

The known slide cylinders, however, are adapted to supply and discharge the pressurized fluid through specific pipe joint ports, so that difficulties are often encountered in connecting the pressurized fluid ducts or pipes depending upon the condition of the place where a slide cylinder is to be installed.

DISCLOSURE OF THE INVENTION

A slide cylinder of the known type, such as the one disclosed in U.S. Pat. No. 3,994,539, comprises a cylinder block having two juxtaposed cylinders, a piston fitted in each cylinder, and a piston rod projecting on both sides of the piston, with each of the piston rods connected to a common cross plate, and is designed to reciprocate the piston rods by means of a pressurized fluid supplied and discharged to and from drive chambers defined by the pistons in the cylinder block.

A slide cylinder of this type is usually placed in such a position that a plane containing the axes of the two piston rods is horizontal, with a load imposed on the cylinder block or the cross plates at both ends of the piston rods. In such instances, the piston rods must have large enough diameters to withstand a bending force working thereon. Preferably, the pressurized fluid should be supplied and discharged through the piston rods, i.e., through a fluid passage provided therein. This also necessitates piston rods of a large outside diameter.

This leads to the design need to reduce the difference between the inside diameter of the cylinders and the outside diameter of the piston rods therein. Then, however, difficulties will be encountered in the fitting of the piston rod to the piston.

To ensure accurate machining and assembling of a piston rod and a piston, the piston rod must comprise a straight continuous bar-like member of a single piece. When a piston rod and a piston are integral, the piston rod portion is formed by machining off considerable metal from a material bar whose outside diameter is at least equal to the outside diameter of the piston. This is a waste of material. So a reasonable alternative is to fasten a separately prepared piston to a straight continuous one-piece piston rod. However, the piston cannot easily be secured free of axial backlash by such means as metal rings adapted to be fitted in grooves provided on each side of the piston mounted on the piston rod. Furthermore, cutting deep grooves on both sides of the piston is by no means preferably because it might reduce the strength of the piston rod.

DISCLOSURE OF THE INVENTION

An object of this invention is to provide means to fasten a piston to a piston rod without causing backlash in a slide cylinder of the known type described above in which the difference between the inside diamter of the cylinder and the outside diameter of the piston rod is relatively small.

Another object of this invention is to allow the piston to be fastened to the piston rod as described above by such means as can be prepared easily and at low cost.

In order to achieve the above objects, a slide cylinder comprises a cylinder block internally defining a plural number of parallel cylinder bores, piston rods extended through said cylinder bores, and pistons fixedly mounted on said piston rods in said cylinder bores, defining first and second drive chambers on the opposite sides thereof; communicating passages formed in said cylinder block, one intercommunicating said first drive chambers and the other intercommunicating said second drive chambers; a first fluid supply/discharge passage formed axially through the first one of said piston rods in communication with said first drive chamber; a second fluid supply/discharge passage formed axially through the second one of said piston rods in communication with said second drive chambers; a first fluid supply/discharge port formed in said cylinder block in communication with one of said first drive chambers; a second fluid supply/discharge port formed in said cylinder block in communication with one of said second drive chambers; said first and second drive chambers being selectively connectable to a source of pressurized fluid through one of said first and second fluid supply/discharge ports or fluid supply/discharge ports at the opposite ends of said fluid supply/-discharge passages in said piston rods; platelike cross members integrally connecting said piston rods at the opposite ends thereof; and fixing means provided on said cylinder block and cross members and selectively used for fixing said slide cylinder. Each of said piston rods is made of a straight continuous one-piece bar, and the piston is fastened to the piston rod by fitting a cylindrical portion of the piston to the piston rod, with the ends of the cylindrical portion being caulkingly fitted in the stopper grooves on the piston rod which are provided at the places corresponding to ends of the piston, and the end surfaces of the cylindrical portion pressed against the outer edges of the stopper grooves.

Figure 1:
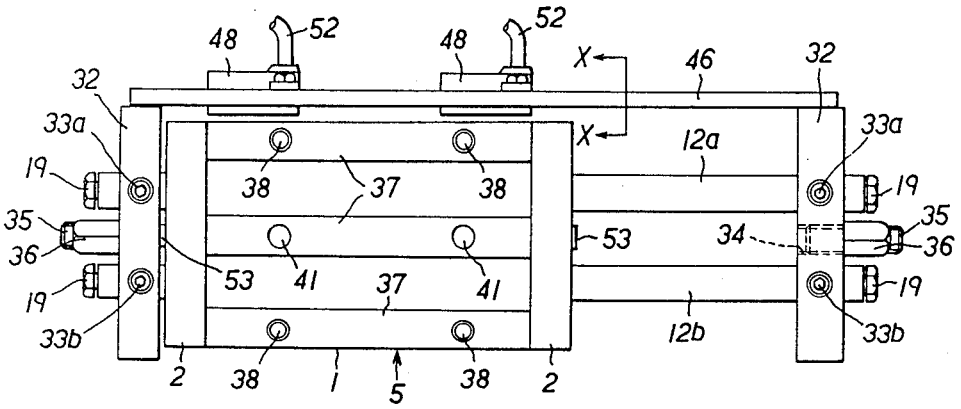
FIG. 1 is a plan view of a slide cylinder embodying the present invention.

THE BEST MODE FOR CARRYING OUT THE INVENTION:

Hereafter, the invention is described in detail with reference to the preferred embodiment shown in the drawings.

Referring first to FIGS. 1 to 4, the slide cylinder according to the invention includes a housing 1 in the form of a thin rectangular parallelopiped with a couple of parallel cylinder bores in the longitudinal direction. End covers 2,2 which are securely fixed to the opposite ends of the housing 1 by screws or other suitable fixing means are provided with through holes 3*a* and 3*b* in concentric relation with the afore-mentioned cylinder bores, respectively, and each formed with a stepped stopper portion on the side of the housing 1 for abutting engagement with a rod cover 4*a* or 4*b* which is fitted in the through holes 3*a* or 3*b*. Thus, a cylinder block 5 is constituted by the housing 1, end covers 2, and rod covers 4*a* and 4*b*.

The rod covers 4*a* and 4*b* are fitted in the bores of the housing 1 fluid-tight, forming a couple of parallel cylinders 7*a* and 7*b* in cooperation with the bores of the housing 1 and the rod covers 4*a* and 4*b*.

A first piston rod 12*a* and a second piston rod 12*b* are fitted in the rod covers 4*a* and 4*b* fluid-tight through rod packing 11*a* and 11*b*, with the opposite ends of the respective piston rods protruded out of the cylinder block 5 as shown.

Figure 5:
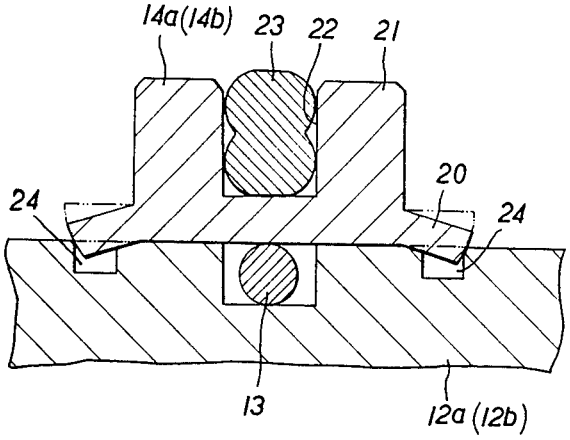
FIG. 5 is an enlarged sectional view showing the relationship between the piston and piston rod of the slide cylinder.

The first and second piston rods 12*a* and 12*b* are securely fixed to a first piston 14*a* and a second piston 14*b*, respectively, through a packing 13 which is fitted in the circumferential groove of each piston (FIG. 5). The piston rods 12*a* and 12*b* are provided with axial fluid feed/discharge passages 16*a* and 16*b*, and define a first drive chamber 15*a* and a second drive chamber 15*b* in the cylinders 7*a* and 7*b*, respectively. The cylinders which are divided into two chambers are communicated with each other through a first intercommunicating passage 8*a* on one side of the pistons and through a second intercommunicating passage 8*b* on the other side of the pistons.

The fluid feed/discharge passage 16*a* which is formed axially through the first piston rod 12*a* communicates with the first drive chamber 15*a* through a passage 17*a* which is opened in the radial direction in the vicinity of the first piston 14*a*, while the fluid feed/discharge passage 16*b* in the second piston rod 12*b* is in communication with the second drive chamber 15*b* through a passage 17*b* which is opened in the radial direction in the vicinity of the second piston 14*b*. Further, the drive chambers 15*a* and 15*b* are opened to the outside of the cylinder block 5 through a fluid feed/discharge port C at one of the housing 1 and through a fluid feed/discharge port D at the other end of the housing 1, respectively.

Accordingly, the first drive chamber 15*a* can be communicated with a pressure source selectively through one of the fluid feed/discharge ports A and F at the opposite ends of the fluid feed/discharge passage 16*a* in the first piston rod 12*a* or the fluid feed/discharge port C in the housing 1. On the other hand, the second drive chamber 15*b* can be communicated with the pressure source selectively through one of the fluid feed/discharge ports B and E at the opposite ends of the fluid feed/discharge passage 16*b* in the piston rod 12*b* or the other fluid feed/discharge port D in the housing 1. These six fluid feed/discharge ports A to F are tapped for engagement with a threaded portion of a pipe connector or a plug 19 . . .

As shown particularly in FIG. 5, the pistons 14*a* and 14*b* are provided with a cylindrical portion 20 which is fitted on the piston rod 12*a* or 12*b* and a bulged portion 21 which is projected in a radial direction from the cylindrical portion 20. A packing 23 of a cocoon shape in section is fitted in a circumferential groove 22 of each bulged portion 21 to seal the corresponding cylinder 7*a* or 7*b*. Further, the piston rods 12*a* and 12*b* each have a packing 13 fitted in a circumferential groove formed in a postion opposing the center portions of the cylindrical portions 20 to provide a seal therearound, and are each provided with stopper grooves 24,25 at positions confronting the opposite ends of the cylindrical portions 20, caulking part of the opposite ends of the cylindrical portion 20 into the stopper grooves 24,24 with tapered surface at both ends thereof in abutting engagement with outer side edges of the stopper grooves 24,24 to fix the piston on the piston rod.

With the above-described construction, the pistons 14*a* and 14*b* each with a cylindrical portion 20 can be fixed without causing backlash on a straight unitary piston rod 12*a* or 12*b* in a facilitated manner, so that it becomes possible to improve the mounting accuracy of the piston and piston rod to a marked degree as compared with an assembly using a separable piston rod for fixing a piston thereon.

Figure 3:
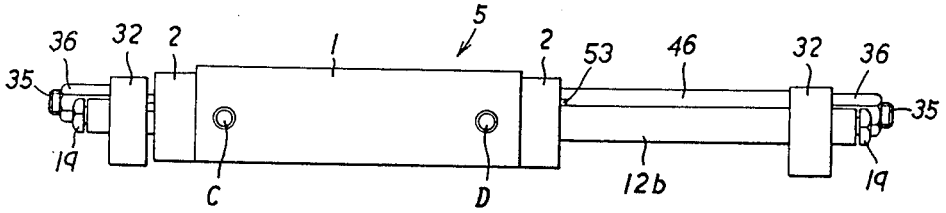
FIG. 3 is a front view of the slide cylinder.
Figure 4:
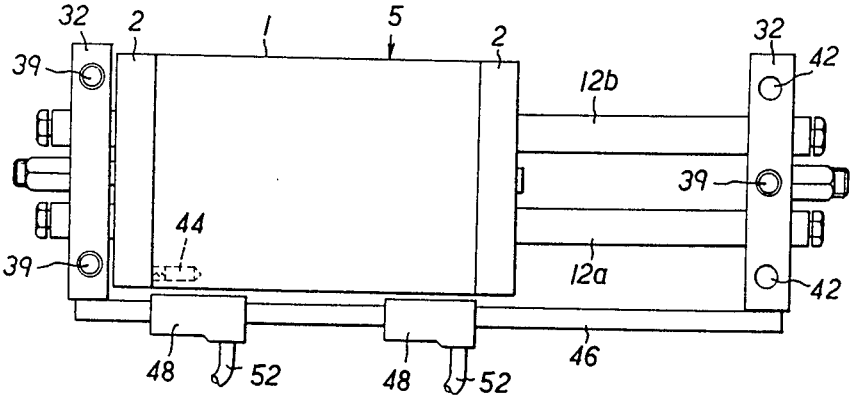
FIG. 4 is a bottom view of the slide cylinder.
Figure 2:
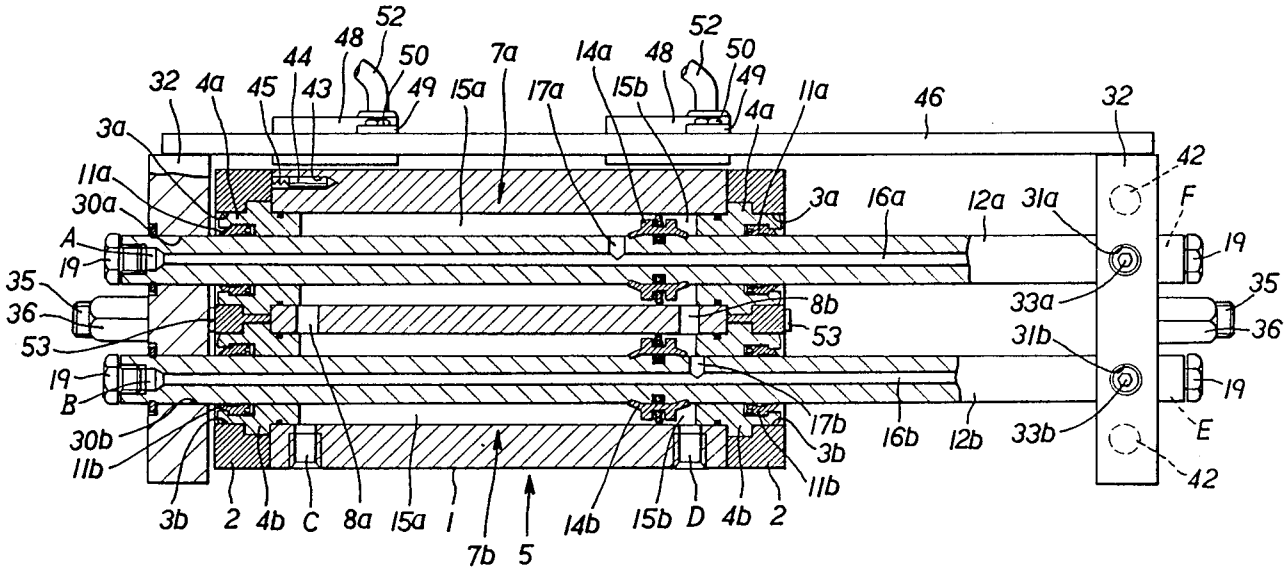
FIG. 2 is a cross section of the slide cylinder, showing its major components.

On the other hand, cross plates 32,32 having through holes 30*a* and 30*b* therethrough with tapped holes 31*a* and 31*b*, which are formed from the top side of the cross plates 32 in communication with the afore-mentioned through holes 30*a* and 30*b*, are fixed to the opposite end portions of the piston rods 12*a* and 12*b* in the through holes 30*a* and 30*b* by threading stop screws 33*a* and 33*b* into the tapped holes 31*a* and 31*b* to move the two piston rods 12*a* and 12*b* as an integral body. As seen in FIG. 3, the upper and lower sides of the plates 32,32 are located at slightly lower levels than the upper and lower sides of the cylinder block 5.

Each one of the plates 32,32 is provided with a tapped through hole 34 at the center of its outer side to receive an adjusting screw 35, fixing the adjusting screw 35 by a long lock nut 36. Upon loosening the lock nut 36, the adjusting screw 35 is movable toward and away from the plate 32,32 to adjust the stroke length by the tip end of the adjusting screw which abuts against the opposing end wall of the cylinder block 5. In this instance, it is preferred to use long lock nuts 36 to facilitate locking of the screw 35 after adjustment and to hold protrusion of the adjusting screw 35 out of the end face of the lock nut 36 to a minimum possible length for the purpose of preventing the danger which might result from reciprocating movements of the plates 32,32.

Further, the housing 1 is provided with a plural number of ribs 37 on the top side thereof in parallel relation with the piston rods 12*a* and 12*b*, of which the outer ribs 37,37 are provided with a plural number of fixing holes 38,38 . . . tapped thereon so that the slide cylinder can be fixed by way of either the screw holes 38,38 . . . or screw holes 39,39, 39 which are tapped on the lower side of the plates 32,32. For fixing the slide cylinder, the cylinder block 5 may be fixed by the use of the fixing screw holes 38,38 . . . since the upper and lower sides of the cylinder block 5 and plates 32,32 are in the above-mentioned positional relationship, or the plates 32 may be fixed by the use of the fixing screw holes 39 with the cylinder block 5 in inverted position. In any case, the cylinder block 5 and plates 32,32 can be put in relative reciprocal motions without any trouble or obstacle.

Instead of these screw holes 38,38—,39,39,39, providing through holes permits the slide cylinder fixing by bolts from either of the top and bottom surfaces.

Further, the centrally positioned rib 37 is provided with positioning holes 41,41 which are accurately aligned with each other in a direction parallel with the piston rods 12*a* and 12*b*, while one of the plates 32 is provided with positioning holes 42,42 on the lower side thereof accurately in alignment with each other in a direction perpendicular to the piston rods 12*a* and 12*b*. These positioning holes 41,41 or 42,42 are fittingly engageable with pins which are provided on a cylinder fixing bed to fix the slide cylinder correctly in position.

A magnet 44 and a spring 45 are fitted in a blind hole 43, which is formed into one end face of the housing 1 close to its lateral side opposite to the fluid feed/discharge ports C and D, urging the magnet 44 toward the bottom of the blind hole 43 by the action of the spring 45.

On the other hand, a rail 46 which links the plates 32,32 is securely fixed to the latter on the side of the blind hole 43 by bolts or other suitable means though not shown in the drawings. This rail 46 is provided with a groove 47 which is open on the outer side through a narrow slot (see FIG. 6).

Figure 6:
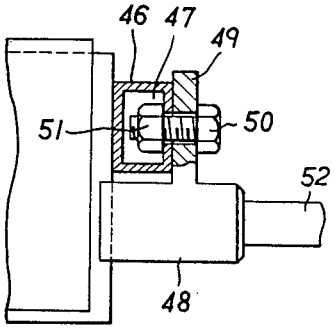
FIG. 6 is an enlarged sectional view, taken on line X—X of FIG. 1.

As illustrated in FIG. 6, magnetic sensor mount members 49 are abutted against the slotted outer side of the rail 46, and bolts 50 are threaded into nuts 51 in the grooves 47 of the rail 46 through the aperture provided on the sensor mount members 49 thereby adjustably fixing magnetic sensors 48,48 relative to the rail 46.

In the case of a slide cylinder installed on it's block side, to avoid movement of magnetic sensor which is connected to electric cable, fixing of magnetic sensors to cylinder block and magnet to piston rod side is favorable. The FIG. 7 shows such case. Magnetic sensor mounting stand 54 is elongated in the direction of piston rod movement. The stand 54 is fixed on a side surface of a cylinder block by screws or the like, magnetic sensors 48,48 are adjustably fixed by bolts 56 and nuts 57, and a magnet case 61 containing a magnet 60 is adjustably fixed at the grooves 47 of the rail 46. The rail 46 is set between the plates 32,32.

The magnetic sensors 48,48 serve to detect the position of the cylinder block 5 by sensing approaches of the magnet 44 resulting from relative reciprocal movements of the cylinder block 5 and plates 32,32, producing a signal upon approach of the magnet 44 for supply to an operation control unit, not shown, through wires 52.

The end covers 2 have patches 53,53 of a hard material securely attached thereto at positions which opposes the tip ends of the adjusting screws 35,35. These patches 53,53 prevent wear of the end covers 2 which would otherwise be caused by repeated abutment thereagainst of the tip ends of the adjusting screws 35,35.

To operate the slide cylinder of the abovedescribed construction, it is firstly fixed by the use of either the fixing screw holes 38,38 . . . or 39,39 . . . , and a pressurized fluid duct is connected to one of the fluid supply/discharge ports A, F and C of the first drive chamber 15*a* and to one of the fluid supply/discharge ports B, D and E of the second drive chamber 15*b*, closing the remaining unnecessary ports with plugs. As each drive chamber is provided with three fluid supply/discharge ports, it is possible to connect the fluid ducts in nine different combinations, selecting suitable ones depending upon the condition of the installing place.

By supplying pressurized fluid through one of the selected fluid supply/discharge ports and discharging the fluid through the other one, the piston rods 12*a* and 12*b* and the plates 32 are moved relative to the cylinder block 5. If the supply and discharge of the pressurized fluid is reversed by a switching means which is not shown, the piston rods 12*a* and 12*b* and plates 32 are moved in the opposite directions. The pressurized fluid is gas or liquid, and supplying gas to the first drive chambers and liquid to the second one is possible. Thus, if the piston rods of the slide cylinder are fixed by the use of the fixing screw holes 39 on the plates 32, the cylinder block 5 is reciprocated between the plates 32 within a range which is limited by the mounting position of the slide cylinder.

In this instance, since a couple of cylinders 7*a* and 7*b* are juxtaposed in parallel relation in a single cylinder block 5, the operating force of the cylinder block 5 or the plates 32 is boosted, coupled with an advantage that relative rotational movements of the piston rods 12*a* and 12*b* and cylinder block 5 are prevented by the plates 32 which are securely fixed to the opposite ends of the piston rods 12*a* and 12*b* to connect same integrally to each other, permitting to provide a slide cylinder of high power and accuracy.

INDUSTRIAL FIELDS OF APPLICATION

As clear from the foregoing description, the slide cylinder according to the present invention is capable of transferring tools or parts in assembling operations or transferring works or jigs with high accuracy free of rotational or flexural movement, and thus particularly suitable for application to arms of robots of general purposes.

What is claimed is:

1. A slide cylinder including a cylinder block internally defining a plural number of parallel cylinder bores, piston rods extended through said cylinder bores, and pistons fixedly mounted on said piston rods in said cylinder bores, said pistons defining first and second drive chambers on the opposite sides thereof, said slide cylinder comprising:

communicating passages formed in said cylinder block, one intercommunicating said first drive chambers and the other intercommunicating said second drive chambers;

a first fluid supply/discharge passage formed axially through a first one of said piston rods in communication with said first drive chamber;

a second fluid supply/discharge passage formed axially through a second one of said piston rods in communication with said second drive chambers;

a first fluid supply/discharge port formed in said cylinder block in communication with one of said first drive chambers;

a second fluid supply/discharge port formed in said cylinder block in communication with one of said second drive chambers;

said first and second drive chambers being selectively connectable to a source of pressurized fluid through one of said first and second fluid supply/discharge ports or through fluid supply/discharge ports at the opposite ends of said fluid supply/discharge passages in said piston rods;

plate-like cross members integrally connecting said piston rods at the opposite ends thereof; and fixing means provided on said cylinder block and cross members and selectively used for fixing said slide cylinder, wherein each of said piston rods is made of a straight continuous, one-piece, bar-like material having stopped grooves, wherein each said piston includes cylindrical portions fitted to one of said piston rods with ends of saud cylindrical portions of the piston being caulkingly fitted in said stopper grooves to fasten said piston to said one of said piston rods, said stopper grooves being provided at portions of said one of said piston rods corresponding to positions of ends of said cylindical portions of said piston, and wherein said ends of said cylindrical portions of said piston are pressed against outer edges of said stopper grooves.

2. The slide cylinder of claim 1, further comprising fixing holes provided on one side of said cylinder block and on the opposite side of said cross members.

3. The slide cylinder of claims 1 or 2, wherein the upper and lower sides of said cross members are slightly staggered relative to the upper and lower sides of said cylinder block, respectively.

4. The slide cylinder in any one of claims 1 or 2, further comprising adjusting screws projected toward said cylinder block from said cross members.

5. The slide cylinder in any one of claims 1 or 2, further comprising a signal generator mounted on said cylinder block, and a position sensor adjustably mounted on a rail fixed between said cross members for detecting signals from said signal generator.

6. The slide cylinder in claim 1, further comprising adjusting screws projected toward said cylinder block from said cross members.

7. The slide cylinder in claim 1, further comprising a signal generator mounted on said cylinder block, and a position sensor adjustably mounted on a rail fixed between said cross members for detecting signals from said signal generator.

8. The slide cylinder in claim 1, further comprising a signal generator mounted on said cylinder block, and a position sensor adjustably mounted on a rail fixed between said cross members for detecting signals from said signal generator.

9. The slide cylinder in claim 3, further comprising adjusting screws projected toward said cylinder block from said cross members.

10. The slide cylinder in claim 3, further comprising a signal generator mounted on said cylinder block, and a position sensor adjustably mounted on a rail fixed between said cross members for detecting signals from said signal generator.

11. The slide cylinder in claim 4, further comprising a signal generator mounted on said cylinder block, and a position sensor adjustably mounted on a rail fixed between said cross members for detecting signals from said signal generator.

* * * * *